US007495163B1

(12) United States Patent
Goodrich

(10) Patent No.: US 7,495,163 B1
(45) Date of Patent: Feb. 24, 2009

(54) WIRELESS MUSICAL KEYBOARD

(76) Inventor: Reed Goodrich, 116 Melody La., East Sound, WA (US) 98245

( * ) Notice: Subject to any disclaimer, the term of this patent is extended or adjusted under 35 U.S.C. 154(b) by 18 days.

(21) Appl. No.: 11/695,445

(22) Filed: Apr. 2, 2007

Related U.S. Application Data

(60) Provisional application No. 60/744,050, filed on Mar. 31, 2006.

(51) Int. Cl.
*G10C 3/12* (2006.01)

(52) U.S. Cl. ..... 84/423 R; 224/270

(58) Field of Classification Search ..... 84/423 R; 224/265, 904, 910, 270
See application file for complete search history.

(56) References Cited

U.S. PATENT DOCUMENTS

| | | | | |
|---|---|---|---|---|
| 3,335,629 | A | 8/1967 | Brodin | |
| 3,541,912 | A | 11/1970 | Radke | |
| 4,099,437 | A | 7/1978 | Stavrou et al. | |
| 4,126,070 | A | 11/1978 | Hill | |
| 4,256,007 | A * | 3/1981 | Streit | 84/421 |
| 4,304,167 | A | 12/1981 | Tait | |
| 4,352,310 | A | 10/1982 | Orlandoni | |
| 4,450,993 | A * | 5/1984 | Ephraim | 224/265 |
| 5,065,661 | A | 11/1991 | Hacker | |
| 5,463,925 | A | 11/1995 | Galocy | |
| 6,019,264 | A | 2/2000 | Strieber | |
| 6,137,675 | A | 10/2000 | Perkins | |
| 6,659,495 | B1 * | 12/2003 | Sanderson | 280/651 |
| 6,772,980 | B2 | 8/2004 | O'Neill | |

OTHER PUBLICATIONS

Reed Goodrich, Declaration, signed in the State of Washington on Jul. 7, 2008, 2 pages.

* cited by examiner

*Primary Examiner*—Walter Benson
*Assistant Examiner*—Jianchun Qin
(74) *Attorney, Agent, or Firm*—Michael F. Hughes; Hughes Law Firm, PLLC

(57) ABSTRACT

A keyboard support adapted to be mounted to the waste portion of a musician providing support arms that are attached to a harness such that the keyboard is allowed to reposition in the lateral direction with respect to the waist portion of the musician. The support arms are further adapted to maintain the keyboard in a proper ergonomic orientation so the musician can play the keyboard while standing as well as moving.

21 Claims, 7 Drawing Sheets

WIRELESS MUSICAL KEYBOARD

RELATED APPLICATIONS

This application claims priority of U.S. Ser. No. 60/744,050, filed Mar. 31, 2006.

BACKGROUND OF THE INVENTION a) Field of the Invention

Musical compositions and more particularly live music has been an age-old form of entertainment. Live performances have captured audiences and to date remain a very large and prolific form of entertainment. Live musical performances and recorded music videos or the like present a visual and auditory form of entertainment that ranges from very large concerts to very quaint performances in smaller venues such as local restaurants and pubs.

It is well known that music is one of the auditory art forms ranging in various styles and forms of compositions. Of course there are many forms of musical instruments. In more modern times (modern relative to centuries of music) pop, rock-and-roll, jazz, alternative and various other forms of music are performed live or performed in some form where the musician is visible by way of television, recorded media, etc. Many forms of music utilize common instruments such as guitar, drums and a keyboard. In certain venues of music, the guitar has been a lead instrument and with the advent of music video, the lead guitarist tends to be a center point of captivity for an audience and in the media. Of course various acrobatic performances are perhaps traditionally more conductive with a guitar is normally hung around the shoulder region of the musician. Such classic rock musical bands such as KISS™ have poineered concert performances with various theatrics. Of course the acrobatic nature of artists such as David Lee Roth are very notable. The desire to be physically active while performing with various musical instruments is not only for the benefit of the audience but also very conducive for the musician as he is in the groove of music which he is producing and more particularly is producing with his band members.

The keyboard has a rich tradition in musical history dating back to the Baroque era where many masterpieces in the classical realm of music have been produced with the fundamental principle of a keyboard-like interface. With the advent of new technology, the notes which are represented by each key or replicated electronically and can be transmitted by way of wires or wirelessly to convey sound by way of amplified auditory means. This, of course, drastically reduces the size of the classic piano to a much smaller unit but traditionally, the keyboard is still somewhat larger than other instruments such as the guitar and not traditionally as conducive for allowing movement by the musician.

However, there are many notable performers that have chosen keyboard as their main instrument of choice. Such performers have traditionally been bound by the static nature of the keyboard and not allowed to express their coordinated physical movements by way of dance or other athletic types of movements during a performance.

As described herein, there is shown an embodiment which is to be construed as being broadly claimed in the attached claims to all alternative embodiments as broadly defined where only, of course, one embodiment of the numerous claimed variations is shown herein.

First there will be a brief description of the known background art to date below.

b) Background Art

In general, the background art as discussed below shows various forms of attempting to allow a keyboard or keyboard-like device with some portability. Further, shown out of an abundance of caution are various devices which are adapted to hold portable electronics such as laptops. However, following the detailed description of the enabling embodiment, it can be appreciated that the various benefits are inherent in the claimed functional design.

The first set of background art references generally show supports for electronic items such as laptops.

A second genre of background art references show various devices adapted to support musical instruments that have keys placed on the instrument to create certain frequencies.

With regard to support devices that are related to electronics in general, references such as U.S. Pat. No. 6,772,980 (O'Neill) discloses an erognomic device for a keyboard computer that allows the user to maintain proper posture. Further, U.S. Pat. No. 5,463,925 (Galocy) discloses a split keyboard where as shown in FIG. 2-3. The reference U.S. Pat. No. 5,065,661 (Hacker) discloses a portable keyboard where a handle 4 is provided as shown in FIG. 2 so the musician can hold the keyboard in a horizontal manner.

The following two references deal with the few wireless transmission of sound. U.S. Pat. No. 4,352,310 (Orlandoni) discloses a portable keyboard that has two hollow tubes. FIG. 5 shows accordion buttons that replace the keyboard unit 12 as shown in FIG. 3. Various other embodiments are shown in this disclosure. The reference U.S. Pat. No. 4,099,437 (Stavrou et al.) primarily discloses a remote wireless instrument showing various schematic drawings.

The following prior art references disclose various body structure supports intended to support a keyboard. U.S. Pat. No. 6,137,675 (Perkins) discloses a supportive belt to allow various interfacing type items such as data input keyboards to be attached thereto. The method of attaching the typing keyboards as shown in FIG. 7 is done by way of the hinge body.

U.S. Pat. No. 6,019,264 (Strieber) discloses a support system adapted to have a shock absorbing type system to be attached to a person. The disclosure is directed to support computer paraphernalia. In particular, this reference does show a support to be strapped to a belt, and further, there appears to a linkage like system with the shock absorbers 18 (see the right hand portion of FIG. 1). Apparently, the section 14 is a cushion section and the spring steel wound shock absorber 16 cooperates with the stiff rubber tubes 18 to handle a downward load upon the tray 60 (see FIG. 2). U.S. Pat. No. 4,450,993 (Ephraim) discloses a keyboard carrier where as shown in FIG. 2, the arms are rigidly attached to the belt plate. Further, the shoulder plates are employed as shown in FIG. 1 to add additional support.

The following references further show musical devices where U.S. Pat. No. 4,304,167 (Tait) discloses a rather interesting musical device where in FIG. 4, the support frame 18 is adapted to wrap around the shoulder region of the musician. U.S. Pat. No. 4,126,070 (Hill) discloses a keyboard instrument which is supported by the strap 30. The reference U.S. Pat. No. 3,541,912 (Radke) discloses a guitar-like keyboard were the shoulder strap loop 1" somehow attaches to the musician. A majority of the disclosure is related to key buttons in the various relay circuits to produce sounds as shown in FIG. 6. Finally the reference U.S. Pat. No. 3,335,629 (Ingemar) discloses a tubelike electrical instrument where the isometricview in FIG. 10 shows a method of using the device. As shown in the various drawings, the shoulder belt is adapted to wrap around the upper portion of the musician.

SUMMARY OF THE DISCLOSURE

Described below is a keyboard support system adapted to support a keyboard to a musician. The keyboard support system in general has a harness, an extension system and a pivot connection mount. The harness has first and second pivot attachment portions.

The extension region is adapted to fixedly mount the harness to a musician where first and second extensions having a base region that is pivotally attached to the first and second pivot attachment portions of the harness. The first and second extensions further have an extended portion pivotally attached to first and second pivot connection mounts.

The first and second pivot connection mounts each comprise a keyboard base portion that is adapted to be mounted to the keyboard and the keyboard is adapted to reposition in a lateral direction with respect to the waist portion of the musician.

In one form the keyboard base portions are rigidly mounted directly to the keyboard. In another form of the keyboard support system the keyboard base portions are mounted to a keyboard support.

The optional keyboard support can have a keyboard base positioning portion comprising a plurality of surfaces defining openings to movably and fixedly position the keyboard base portion of the pivot connection mounts. In one form the keyboard is adapted to be attached by a hook and loop system to the keyboard support.

The keyboard support system can have the pivot connection mount comprising a pivot resistance system adapted to adjust the amount of rotation of the first and second extensions with respect to the first and second pivot connection mounts. In another form, either the first or second extensions are adapted to be resisted in rotation to partially restrain the lateral movement of the keyboard with respect to the waist portion of the musician.

The keyboard support system can have the pivot connection mounts have an extension adjustment feature adapted to adjust the length of the pivot connection mount to the waist portion of the musician. Of course, other variations and additions are disclosed below where the claims are to be construed in their broadest light.

DETAILED DESCRIPTION OF THE PREFERRED EMBODIMENTS

Figure 1:
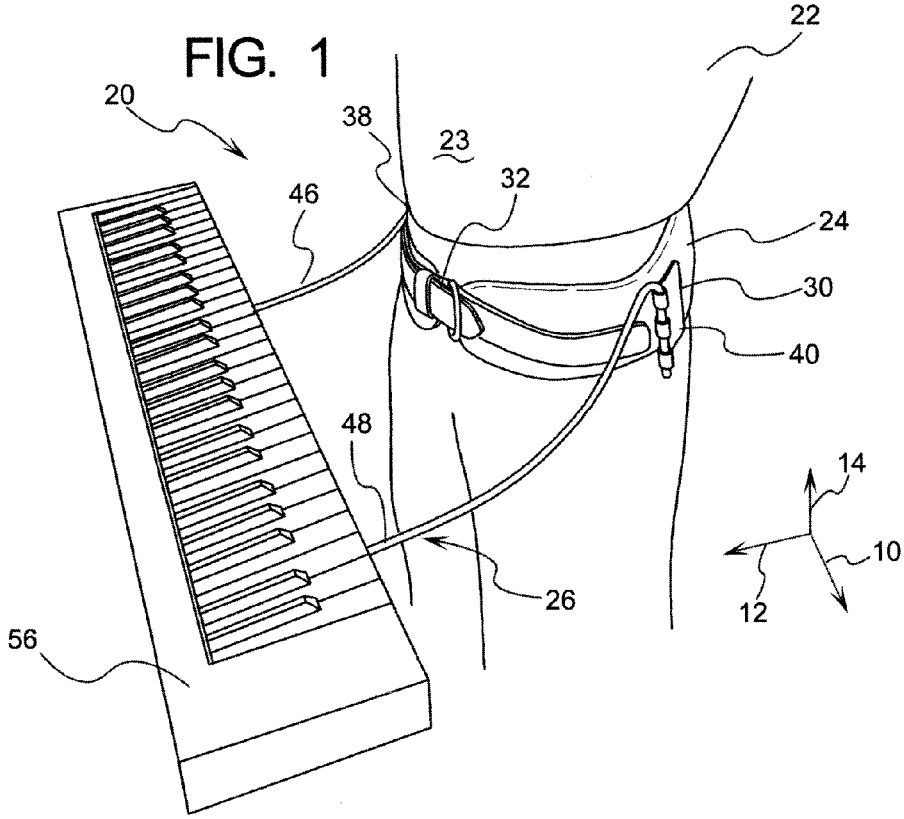
FIG. 1 shows an isometric view of the keyboard support system mounted to a musician.
Figure 2:
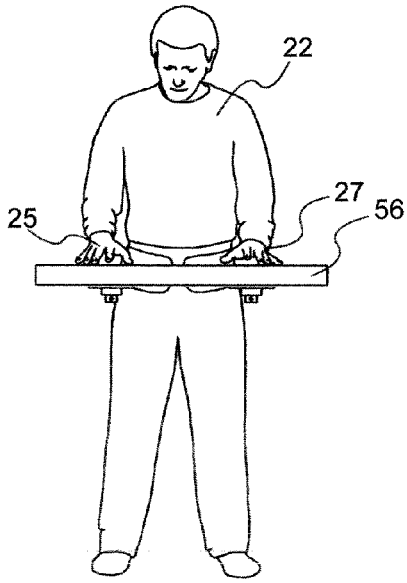
FIG. 2 shows a front view of the keyboard support system attached to a keyboard with the base region mounted to the waist portion of the musician.

As shown in FIG. 1, there is a keyboard support system 20. To aid in the description of the keyboard support system, an axes system is defined where as shown in FIG. 1, the axis indicated at 10 indicates a lateral direction and for reference purposes, with respect to the musician 22, this axis is pointing to his left which is defined as the first lateral direction. The axes indicated at 12 is a transverse axis pointed in a forward direction. Finally, the axis indicated at 14 is a vertical axis of course pointed in a vertical or upward direction. The axes are not intended to limit the embodiment to any particular direction or orientation but rather used to aid in the description of the various components and their orientation and relative movement.

Figure 9:
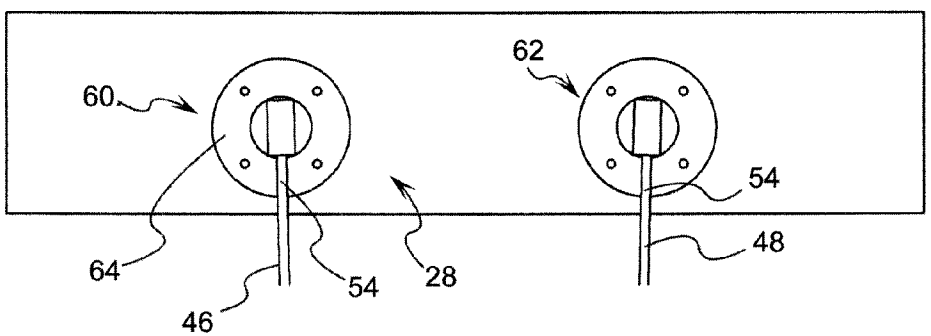
FIG. 9 shows a bottom view looking upward of the keyboard attachment region of the keyboard support system.

Still referring to FIG. 1, there is shown a musician 22. The musician 22 is a keyboard player which is general is desirous of playing the keyboard 56 (such as a Roland PC-200 ARC2) mini keyboard controller). The keyboard is a wireless keyboard such as a computer keyboard for plugging into a personal computer. The keyboard is played while standing or otherwise have the keyboard move relative to the musician. In general, the keyboard support system comprises a base mount region 24 and an extension region 26, and as shown in FIG. 9, a keyboard attachment region 28.

Referring back to FIG. 1, the base mount region 24 in one form comprises a harness 30. The harness 30 is in one form a belt-like device where an adjustment portion 32 is provided which in one form is a buckle-like fastener. Of course any form of adjusting the circumferential range of the harness 30 can be provided, such as a hook and loop type fastening system (e.g. Velcro™).

Figure 8:
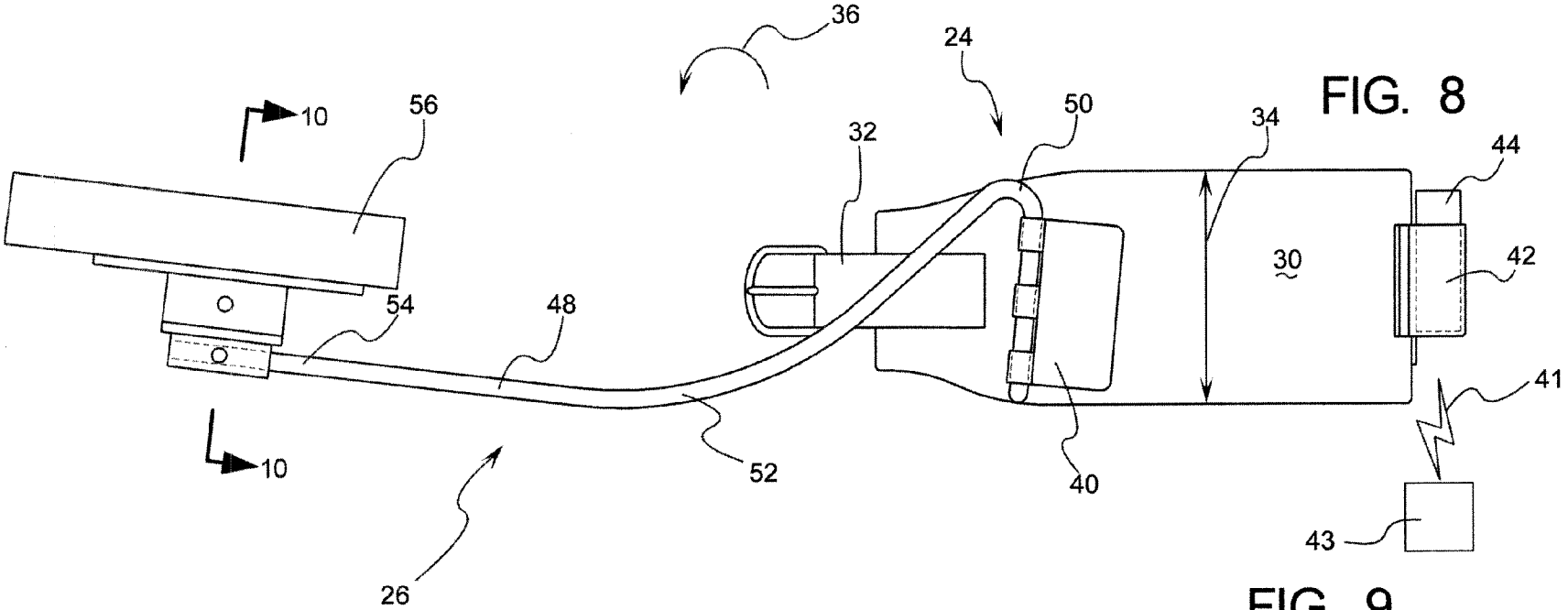
FIG. 8 is a side view of the keyboard support system.

As shown in FIG. 8, in one form, the harness 30, which is a preferred form of a base mount region 24, has a vertical height indicated as 34 which is sufficiently high to address a torqueing-like moment as indicated by the moment vector 36. In other words, the weight of the keyboard 56 pressing downwardly creates a center of gravity shift-like moment 36 which is transferred to the extension region 26 to the first and second pivot attachment portions 38 and 40. Therefore, by having the material of the harness 30 be sufficiently extended in the vertical direction, the weight and the moment of the keyboard is properly distributed to the waist portion 23 (see FIG. 1) of the musician 22.

As further shown in FIG. 8, the base mount region 24 further comprises first and second pivot attachment portions 38 and 40 (the first pivot attachment is partially shown in FIG. 1 but basically replicates or is similar to the second pivot attachment portion 40). Positioned in the rearward portion of the harness 30 are pouches 42 that are adapted to hold electronics 44 such as a wireless transmitter which in one form wirelessly transmits the information 41 from the keyboard 56 to sound producing elements 43 such as in one form amplifiers and speakers for sound production. In one form the electronics only send signals to a sound module and mixing board (collectively 43) and any sound can be produced from the keyboard 56. So for example three keyboard musicians can play various types of instruments from only using keyboards. The electronics can have a FM transmitter to modulate the information and transmit the signal to the receiving unit such as a X-Wire (in one form) and sends the signal to the sound module and then to the mixing board. The pocket 42 can have three portions holding the signal receiver from the keyboard which transfers signals to the transmitter such as a FM signal sender/receiver in an adjacent pocket to convert the signal converter. A the third pocket can be used for a wireless microphone interface device.

In one form the approximate weight of the keyboard 56 is relatively light and has its own power supply by way of conventional batteries and is less than ten pounds. The keyboard therefore in one form does not have onboard sound and is producing digital signals. The keyboard can weigh approximatley 8–12 lbs. and in one form is less than 20 lbs. for proper support of the harness.

Figure 6:
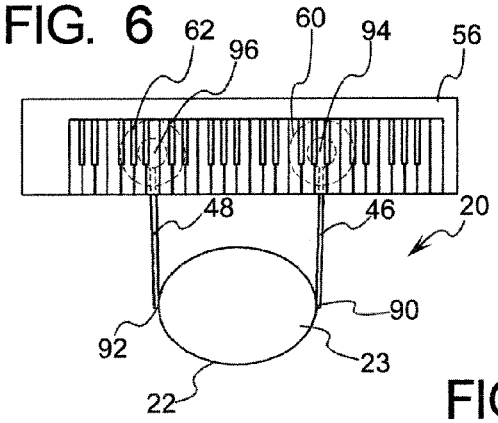
FIG. 6 shows the keyboard support system in a top view.
Figure 7:
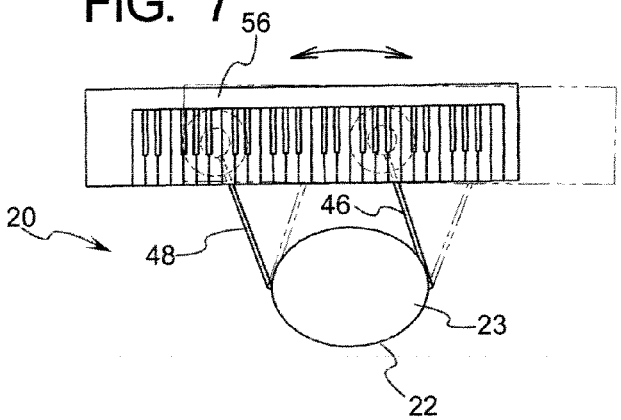
FIG. 7 shows the keyboard support system illustrating one form of the linkage mechanism which allows the item to relocate laterally with respect to the musician.

Referring back to FIG. 1, the extension region 26 in one form comprises first and second extension members 46 and 48. The extension members such as that as shown in FIG. 8 comprise a base region 50, a central region 52, and an extended region 54. Essentially, the extension region 26 is adapted to position the keyboard indicated at 56 in a proper erogonomic location from the musician 22. Described further herein are various attachment and adjustment means for accomplishing this relationship. As shown in FIGS. 2-5, it can be appreciated that the cooperation of the components can allow for a dynamic range of motion of the keyboard 56 with respect to the musician 22 and more particularly with respect to the musician's waist portion 23. It can also be appreciated that the keyboard 56 has the ability to reposition in the lateral direction as indicated in FIGS. 6-7. As described further herein, essentially in the shown embodiment, one possible linkage mechanism is what is referred to as a four-bar linkage in engineering parlance, where the waist portion 23 of the musician is a base linkage and the first and second extension members 46 and 48 operate as two additional linkages and the keyboard 56 by either a direct connection, or by way of a platform, operates as a fourth linkage. Of course, depending upon the distance between the pinpoints described herein, the motion of the keyboard 56 can vary where the keyboard translates, or depending upon the location of the pivot points has a slight rotational component about a vertical axis.

Figure 10:
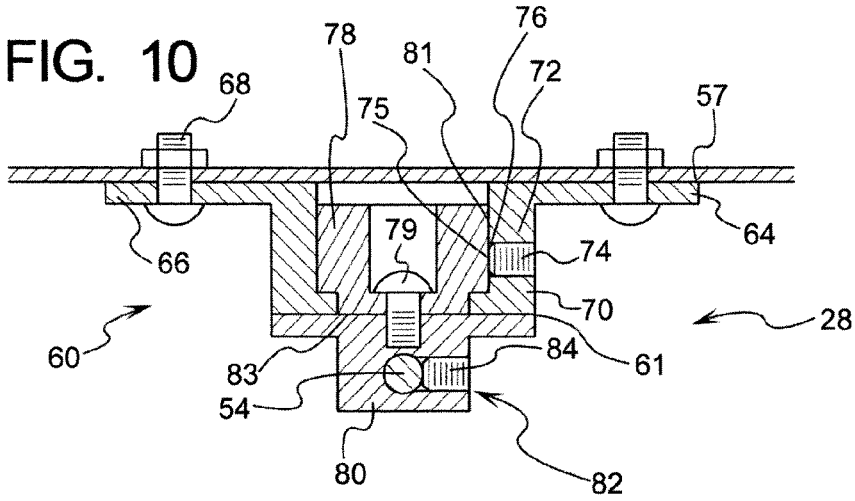
FIG. 10 shows one form of a good connection mount in a cross-sectional view.
Figure 11:
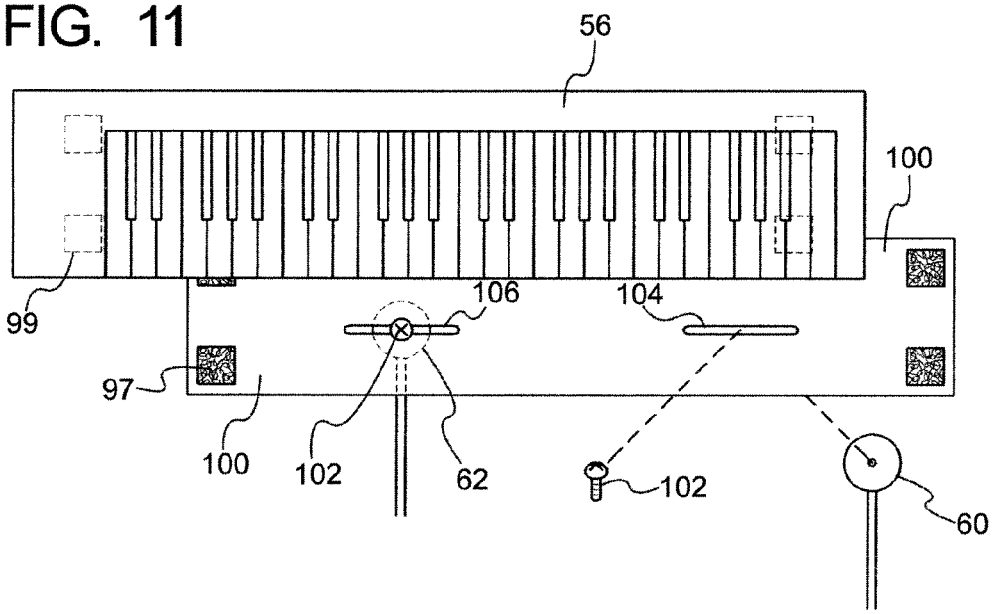
FIG. 11 shows another embodiment where the keyboard support is utilized.

Referring back now to FIG. 8, there will now be a continued discussion of one embodiment of the invention of the extended region 54 of the extension member 48 (where only the second extension member 48 is shown but of course the disclosure relates to the first extension member 46 as well). The extended region 54 interfaces with the keyboard attachment region 28 as shown in FIG. 9. As shown in FIG. 10, one form of a keyboard attachment region 28 of the keyboard support system 20 is a pivot connection mount 60. More particularly, as shown in FIG. 9, there are provided first and second pivot connection mounts 60 and 62 where the first pivot connection mount will be described in detail with the understanding that the discussion relates to the second pivot connection mount. Of course, each one of these could vary from one another in the broader scope and in some instances may while relating to the inner resistance system described herein. Basically, the pivot connection mount comprises a keyboard base portion 64. The keyboard base portion 64 can either directly mount to the keyboard or intermittently mount to a support 100 as shown in FIG. 11.

As shown in FIG. 10, the keyboard base portion 64 in one form has a dampening system 61 and comprises an annular ring 66 comprising one or more fasteners 68. Of course, the fasteners can be a variety of forms such as a nut and bolt arrangement or a screw to engage into the outer fixture of the keyboard 56. Alternatively, the annular ring could be applied by way of an adhesive or removably attached by a hook and loop type system. At any rate, the fastening system in generally from the pivot connection mounts 60 and 62 should be sufficient so the keyboard remains intact to the first and second extension members 46 and 48 (see FIG. 1) so the keyboard can handle the rigors of a performance without becoming detached. In one forms of providing a pivot connection mount, a cylindrical-like portion 70 is provided where a pivot resistance system 72 in one form is a set screw 74 that frictionally engages the outer surface 76 of the internal member 78. The internal member 78 is attached to the lower support 80 by way of the fastener, for example 79, and the lower support 80 in turn is attached to the extended region 54 of the first and second extension members 46 and 48 (where of course only one of the extension members is shown in FIG. 10). An extension adjustment feature 82 is provided which in one form is a set screw 84 which frictionally engages the outer surface of the extended region 54 of the extension members. Of course other forms of a dampening system 61 and be employed to resist rotation of the keyboard with respect to one or both of the extension members. Alternatively the dampening system can be the waist of the musician and be provided to resist the rotation of either (or both) of the extension members. In other forms a wingnut like adjustment member can be used to adjust the tension of the dampening without tools such as between songs with varied physical performance levels.

In one form of operation, the extension adjustment feature fixedly determines the length of the respective extension member 46 or 48. The musician or other support technician can adjust the pivot resistance system 72 which in one form is adjusting a set screw which could have a mylar or nylon or other wear-resistant portion 75 that frictionally engages the outer surface 81 of the internal member 78. Essentially, given the coefficient of friction between the surfaces 75 and 81, the amount of normal force can be adjusted by repositioning the set screw 74. This, of course, determines the resistance for the lateral movement of the keyboard 56 as illustrated in FIGS. 6 and 7.

Of course as noted above there are various attachment type mechanisms and variations for the other resistance system. For example, there could be gearing like mechanisms, or frictional engagement on say for example the lower surface 83 as shown in FIG. 10, or any other form of impeding or controlling rotational movement of the keyboard 56 with respect to either or both of the extension members 46 and 48 as illustrated in FIG. 7.

With the foregoing description in mind, there will now be a detailed discussion of the kinematic relationship of the moving components followed by discussion of the method of adjustment of the first and second extension members. As shown in FIG. 6, there is shown a top view of the keyboard support system 20. With regard to the linkage system which is one form of supporting the keyboard 56, the main embodiment shows a four-bar linkage. The first and second extension members are pivotally attached at the pivot locations 90 and 92. These extension members are further pivotally attached at the locations indicated at 94 and 96. The pivot locations 94 and 96 in one form can be repositioned with respect to one another and with respect to the pivot location 90 and 92. As shown in FIG. 7, if the pivot locations between 94 and 96 and 90 and 92 are substantially the same distance and further if the pivot locations between 92 and 96 and between 90 and 94 are substantially similar then the keyboard 56 will translate only (and not rotate with respect to itself) and reposition about the musician's waistline indicated at 23.

Figure 12:
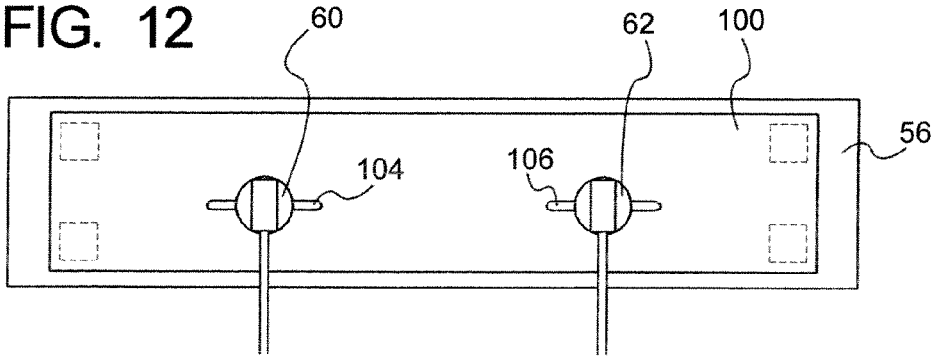
FIG. 12 is a bottom view of the keyboard support.

Now referring to FIG. 11, there is shown one embodiment where instead of having the pivot connection mount 62 directly attached to the keyboard 56, the pivot connection mounts 60 and 62 are connected to the keyboard support 100. The fastener 102 which can be a variety of forms in one form can be a bolt which threadedly engages to the pivot connection mount 60 and 62 and allows for repositioning of the pivot connection mount with respect to the keyboard support within the adjustment slots 104 and 106. In other words, as shown in FIG. 12, which is a bottom view of the keyboard support 100, the first and second pivot connection mounts are temporarily fixedly positioned to the keyboard support 100 which is to the musician's liking. For example, if the musician desired the keyboard to rotate thereabout his waist when the keyboard were shifted in the lateral direction, he or she may widen the pivot locations of the pivot connection mount 60 and 62 to a wider location than the pivot locations 90 and 92 (see FIG. 6). By widening these pivot locations which will have an effect where the keyboard will have a greater tendency to rotate about the musician 22 when repositioned laterally. Of course the musician can adjust this feature to erogonomically allow him to play the keyboard while the keyboard is in various orientations as shown in FIG. 7 with respect the musician 22. It should be noted that in one form, a hook and loop fastener system such as that as shown in 97 and 99 can be utilized to fixedly and removably attach the keyboard 56 to the keyboard support 100. This allows the musician to quickly change keyboards during a performance or any other time.

Figure 13:
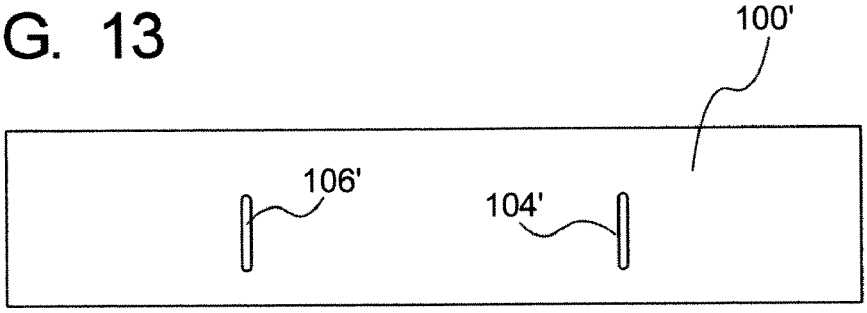
FIG. 13 shows another embodiment of any keyboard support where position slots are positioned to adjust the system in the transverse direction.
Figure 14:
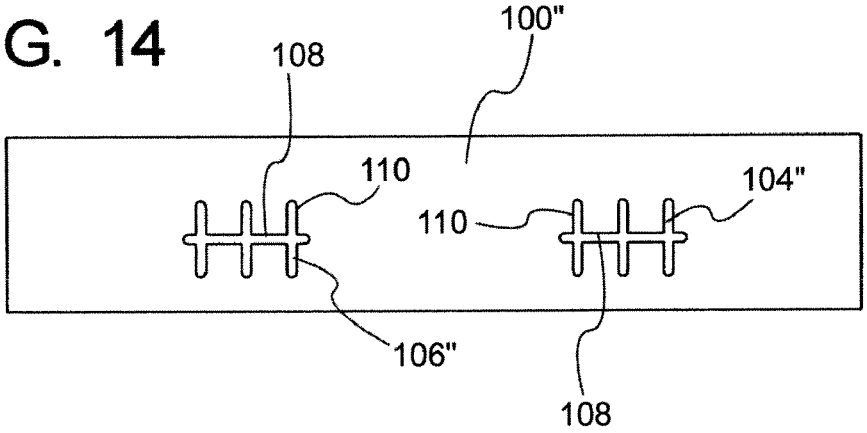
FIG. 14 shows another variation with the slots extending in the lateral direction to accommodate the various widths of the musician and to further allow for different types of movement in the lateral direction with possible rotation about a vertical axis.
Figure 15:
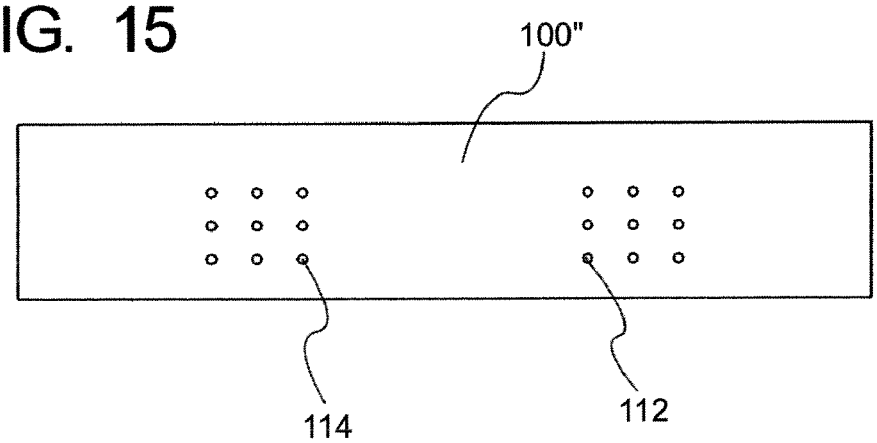
FIG. 15 shows another possible variation where in this form a plurality of openings are provided to allow the musician various ways of adjusting the pivot connection mounts.

Now referring to FIG. 13, there is shown other forms of a keyboard support where 100' shows a modified from where the lateral width is substantially fixed but the musician or musical technician can adjust the pivot connection mounts within the adjustment slots 104' and 106'. As shown in FIG, 14, the mount 100" shows adjustment slots 104" providing a lateral width component 108 and a plurality of transverse adjustment components 110. FIG. 15 shows yet another keyboard support 110'" where the surfaces defining the openings 112 and 114 can be utilized to adjust the position of the pivot connection mounts. Of course the last two figures are shown just by way of an example where they are to be interpreted broadly as any way of adjusting the location of the pivot connection mounts which could further include a suction like apparatus, a magnetic force type connection, or Velcro upon the upper surface 57 as shown in FIG. 10 to a corresponding hook and loop fastener fabric like system on the bottom portion of the keyboard 56.

Figure 3:
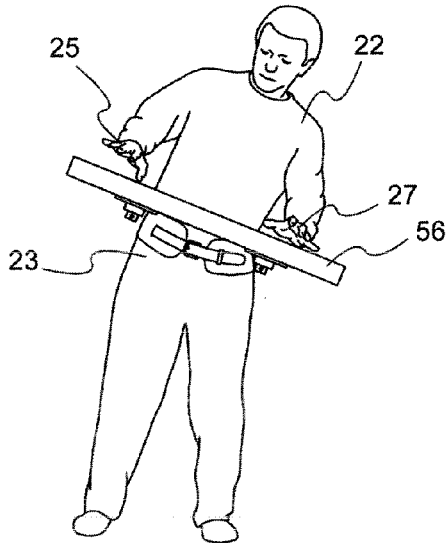
FIG. 3 shows the musician twisting his body about a transverse axis where the keyboard is positioned in a proper ergonomic position.
Figure 4:
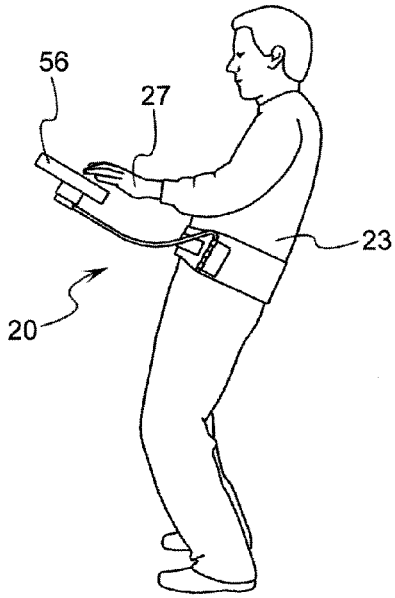
FIGS. 4-5 show the musician tilting about a lateral axis where the keyboard remains in a substantially proper ergonomic orientation relative to the hands of the musician.
Figure 5:
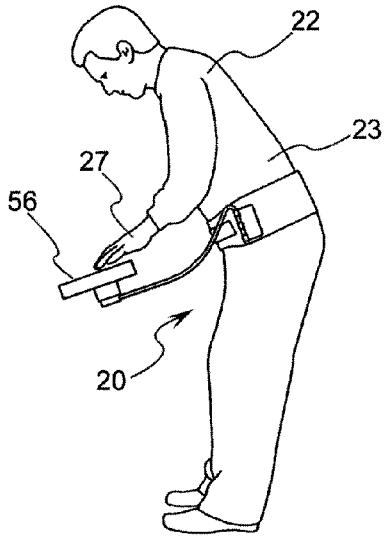

Now referring to FIGS. 2-5, with the foregoing technical description in place, it can be appreciated that the extension members allow for movement of the keyboard 56 with respect to the musician 22 where as shown in FIG. 3, as the musician 22 rotates his waist portion 23 about a transverse axis, this translates into movement of the keyboard 56 where the musician's hands 25 and 27 are still properly placed in an ergonomic orientation to allow him to continue to play. As shown in FIG. 4, the musician is not rotated substantially about the lateral axis where he is in a more supine position in FIG. 4, yet his hand 27 is still in a proper orientation to play the various keys of the keyboard 56. Further, as shown in FIG. 5, the musician 22 has leaned forward and perhaps is in dynamic movement; however, the keyboard 56 remains in a proper ergonomic orientation. Of course it should be reiterated that lateral movement such as that shown in FIG. 7 can occur simultaneously with the various repositions about the vertical and lateral axis which could all occur simultaneously depending upon the skill and agility of the musician. However, the keyboard support system 20 facilitates such movement.

It should be noted that the extension region 26 is defined broadly in one form, the members 46 and 48 are employed but in the broader scope any type of structure that mounts the keyboard away from the waist of the body can be utilized. Of course this could include triangulating members, structure-like members having rigid portions and flexible portions in tension. Further, the pivot connection mounts are also defined broadly to the mount which effectively is mounted to the keyboard. The keyboard base portion of the mount is defined broadly to any type of structure that is mounted to the keyboard. The term mounted to the keyboard is also defined broadly which could be a direct mount or with, for example, a material such as the keyboard support interposed there between.

Figure 16:
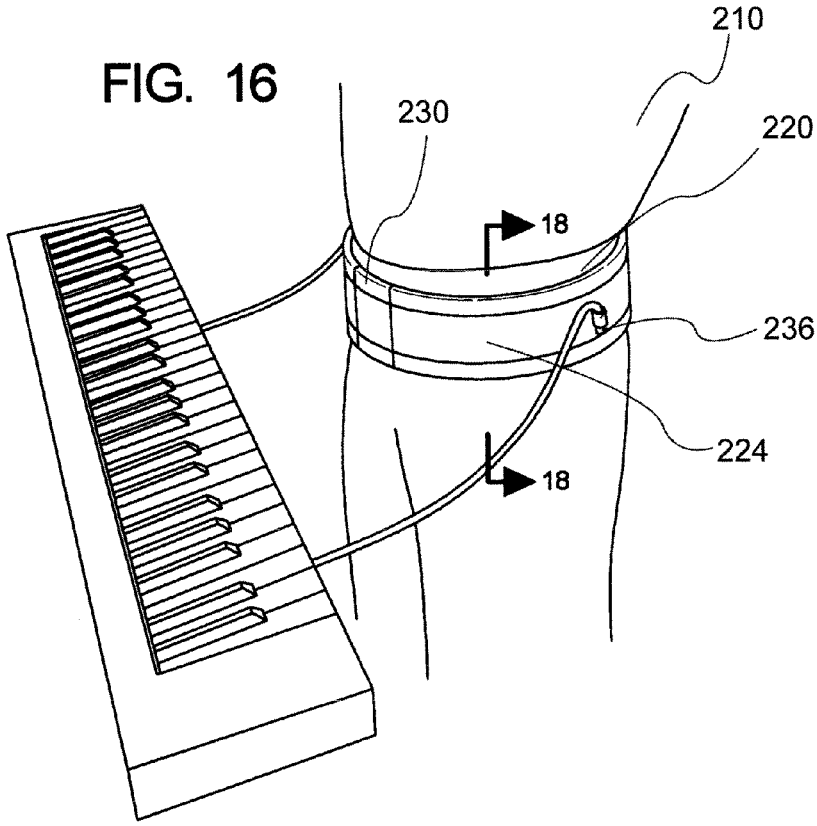
FIG. 16 shows another embodiment where a rotatable mount is provided to additionally provide rotation of the extension region with respect to the individual.
Figure 17:
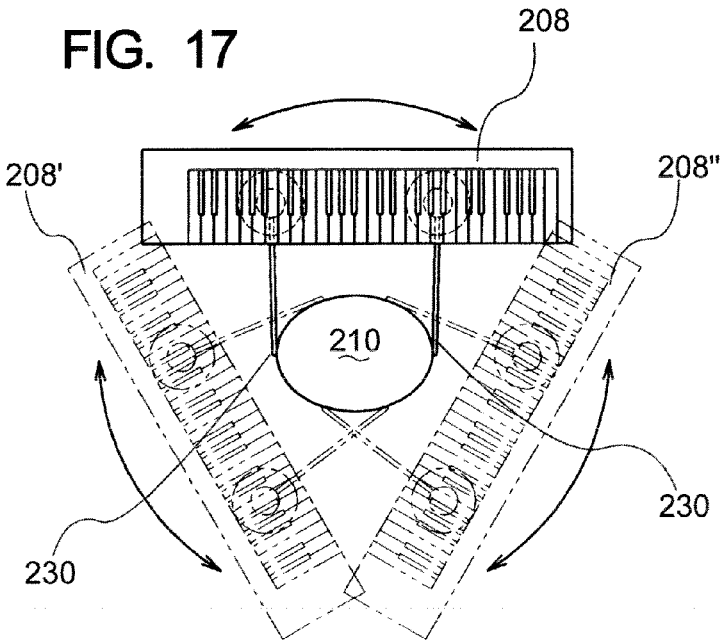
FIG. 17 shows a schematic top view to restrain the rotation of the keyboard member around an individual.
Figure 18:
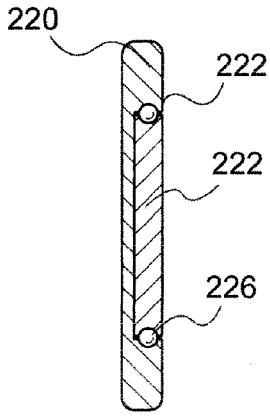
FIG. 18 is taken along line 18-18 of FIG. 16 showing a schematic bearing system.

Now referring to FIG. 16, there is shown a belt member 220 which is positioned adjacent to the musician 210. As shown in FIG. 18, the belt member 220 provides a channel portion 222 where the rotatable track 224 is positioned therein. In one form, the rotatable track can be attached by way of bearing members 226 or the like. As shown in FIG. 16, in one form, the belt member 220 can be fitted to the waist portion of the individual 210. A buckle region 230 can provide a certain amount of adjustment, where perhaps a certain type of intermediate buckles is positioned therein to provide adequate spacing between the end regions of the belt member 220. The rotatable mount 224 is adapted to rotate with respect to the musician's waist as shown in FIG. 17. The mount points 236 can be adjustable with respect to the rotatable mount 224 to provide a desired position for the lateral movement of the keyboard member 208. In an optional form, a locking mechanism which perhaps can be incorporated at the buckle region 230 can be employed to temporarily lock the rotatable mount 224 with respect to the belt member 220 for better control of the keyboard.

Figure 19:
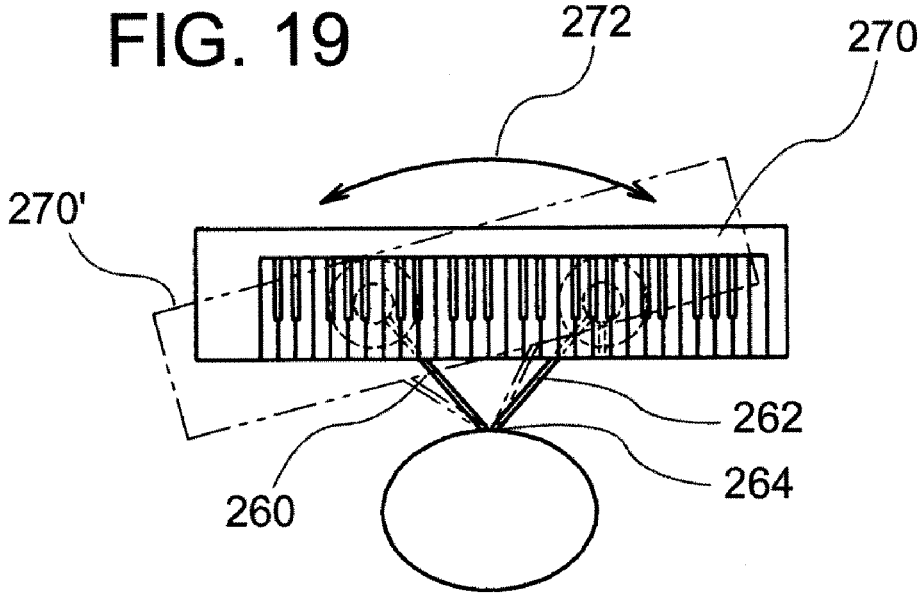
FIG. 19 shows another embodiment where the extension members are attached at a more central location.

FIG. 19 shows an embodiment where the keyboard as shown in 208 can be swung around the hips like a Hoola Hoop to a position as shown in 208 and further all the way around to 208" until it is repositioned back in the area in the front portion of the musician indicated at 208 having a 360°. Of course, this type of motion can add a theatrical effect to a musical performance, whereby as mentioned above the musician swirls the keyboard around in a hula-hoop like hip action. Of course, having this type of mobility with the keyboard can serve to draw attention to the keyboardist during a musical performance.

Of course it should be noted that having the weight transferred to the hips and not the shoulders where even a load of the keyboard, the harness and electronics will not fatigue the musician whereas having the load on the shoulder region of a musician can be very fatiguing.

While the present invention is illustrated by description of several embodiments and while the illustrative embodiments are described in detail, it is not the intention of the applicants to restrict or in any way limit the scope of the appended claims to such detail. Additional advantages and modifications within the scope of the appended claims will readily appear to those sufficed in the art. The invention in its broader aspects is therefore not limited to the specific details, representative apparatus and methods, and illustrative examples shown and described. Accordingly, departures may be made from such details without departing from the spirit or scope of applicants' general concept.

I claim:

1. A musical keyboard support system operatively configured to support a keyboard to a musician for a musical performance, the keyboard support system comprising:

a. a harness having first and second pivot attachment portions;

b. an extension region operatively configured to fixedly mount the keyboard to the musician, the extension region comprising first and second extensions each comprising a base region pivotally attached to the first and second pivot attachment portions of the harness, the first and second extensions further having an extended portion pivotally attached to first and second pivot connection mounts;

c. whereas the first and second pivot connection mounts each comprise a keyboard base portion that is operatively configured to be mounted to the keyboard where each of the first and second pivot connection mounts comprise an internal member having a partially cylindrical surface that interfaces with a partially cylindrical surface of said base portion and the internal member further has a lower support and the keyboard is operatively configured to reposition in a lateral direction during a musical performance with respect to the waist portion of the musician by pivotal movement about the base regions of the first and second extensions at the first and second pivot attachment portions of the harness and further, pivotal movement about the first and second pivot connection mounts, whereby each lower support of the first and second pivot connection mounts are fixedly and adjustably attached to the extended portions of the first and second extensions so as to be adjustable to reposition the first and second pivot connection mounts and to reposition the keyboard at a desired distance from the musician.

2. The music keyboard support system as recited in claim 1 where the keyboard base portions are rigidly mounted directly to the keyboard.

3. The music keyboard support system as recited in claim 1 where the keyboard base portions are mounted to a keyboard support.

4. The music keyboard support system as recited in claim 3 where the keyboard support has a keyboard base positioning portion comprising a plurality of surfaces defining openings to movably and fixedly position the keyboard base portion of the pivot connection mounts.

5. The music keyboard support system as recited in claim 3 where the keyboard is operatively configured to be attached by a hook and loop system to the keyboard support.

6. The music keyboard support system as recited in claim 1 where the pivot connection mount comprises a pivot resistance system adapted to adjust the amount of rotational resistance of the first and second extensions with respect to the first and second pivot connection mounts.

7. The music keyboard support system as recited in claim 1 where either the first or second extensions are operatively configured to supply rotational drag in rotation thereof with respect to the waist portion of the musician.

8. The music keyboard support system as recited in claim 1 where the pivot connection mount comprises an extension adjustment feature adapted to adjust the length of the pivot connection mount to the waist portion of the musician.

9. A method of providing a keyboard support to an individual comprising the steps of:

d. providing a harness fixedly and removably positioned around the midsection of an individual, the harness having first and second pivot attachment portions, e. having first and second extension members extending from the harness in a forward direction with respect to the individual, attaching the first and second extension members to the first and second pivot attachment regions of the harness, f. pivotally attaching connection mounts each having a base portion pivotally attached to a support that allows movement of the connection mounts with respect to the first and second extensions and where a dampening system is provided to resist rotation of the keyboard with respect to either the first or second extensions to a forward connection region of the first and second extension members, g. attaching the connection mounts to a wireless keyboard, h. positioning the keyboard to an ergonomic location with respect to the musician by way of adjusting the attachment of the supports of the connection mounts with respect to the first and second extensions for providing lateral movement of the keyboard with respect to the musician by pivotal movement of the first and second extension members.

10. The method as recited in claim 9 where the individual, the first and second extensions and the keyboard are positioned to comprise a four bar linkage assembly.

11. The method as recited in claim 10 where the pivot locations at the first and second pivot attachment portions of the harness to the pivot locations of the first and second pivot mounts respectively are equidistant.

12. The method as recited in claim 10 where the keyboard is configured to reposition laterally with respect to the individual and substantially not rotate.

13. The method as recited in claim 9 where the first and second pivot attachment portions of the harness are rotatably attached thereto for rotation around the individual.

14. The method as recited in claim 9 where the first and second extensions have a locked position to the supports of the first and second connection mounts by way of frictional engagement of set screws within each of the supports of the first and second connection mounts.

15. A musical keyboard support system operatively configured to support a keyboard to a musician, the keyboard support system comprising:

a. a harness system having a first pivot attachment and second pivot attachment;

b. an extension assembly operatively configured to fixedly mount the harness system to a musician, the extension assembly pivotally attached to the first and second pivot attachments of the harness by first and second extensions, the extension assembly having an extended portion pivotally attached to first and second pivot connection mounts at a first and second support that comprise a surface defining a slot that is operatively configured to house the first and second extensions to adjust the distance of the first and second pivot connection mounts where the first and second support comprise an extension member to engage the first and second extensions for locking the support thereto;

c. whereas the first and second pivot connection mounts each comprise a keyboard base portion that is operatively configured to be mounted to the keyboard and the keyboard is operatively configured to reposition in a lateral direction with respect to the waist portion of the musician by pivotal movement of the extension.

16. The music keyboard support system as recited in claim 15 where the keyboard base portions are rigidly mounted directly to the keyboard.

17. The music keyboard support system as recited in claim 15 where the keyboard base portions are mounted to a keyboard support and the keyboard support has a keyboard base positioning portion comprising a plurality of surfaces defining openings to movably and fixedly position the keyboard base portion of the pivot connection mounts.

18. The music keyboard support system as recited in claim 15 where a the keyboard is a wireless keyboard system configured to allow a musician to play a wireless keyboard, the wireless keyboard comprises a wireless transmission member configured to transmit signals from the wireless keyboard to sound producing elements.

19. The music keyboard support system as recited in claim 18 where the extension assembly is pivotally attached to the harness.

20. The music keyboard support system as recited in claim 18 where a dampening system is provided to resist the rotation of the keyboard with respect to the extension members.

21. The wireless keyboard system as recited in claim 20 where the extension assembly comprises first and second extension members are attached to first and second pivot connection mounts which are connected to a support that is operatively configured to attach to the wireless keyboard and lock the wireless keyboard at selective locations.

* * * * *